US007578412B2

(12) United States Patent
Clamage

(10) Patent No.: US 7,578,412 B2
(45) Date of Patent: Aug. 25, 2009

(54) CONTAINER HAVING GRIPPING RECESSES

(75) Inventor: Eric D. Clamage, Stamford, CT (US)

(73) Assignee: Kraft Foods Global Brands LLC, Northfield, IL (US)

( * ) Notice: Subject to any disclaimer, the term of this patent is extended or adjusted under 35 U.S.C. 154(b) by 801 days.

(21) Appl. No.: 10/897,401

(22) Filed: Jul. 23, 2004
(Under 37 CFR 1.47)

(65) Prior Publication Data

US 2006/0027585 A1 Feb. 9, 2006

(51) Int. Cl.
*B65D 1/46* (2006.01)
*B21D 51/26* (2006.01)

(52) U.S. Cl. ..... 220/771; 215/384; 72/370.04; 72/379.4

(58) Field of Classification Search ..... 215/384, 215/396, 398, 698; 220/771, 674.677; 72/375.4, 72/379.4, 370.04
See application file for complete search history.

(56) References Cited

U.S. PATENT DOCUMENTS 1,151,983 A * 8/1915 Winfield ..... 72/379.4
1,856,941 A * 5/1932 Anderson ..... 220/787
2,059,292 A * 11/1936 Taylor ..... 72/379.6
2,063,013 A * 12/1936 Cooper ..... 220/669
3,225,950 A * 12/1965 Fulcher et al. ..... 215/384
3,420,367 A * 1/1969 Carmichael ..... 206/432
D224,382 S * 7/1972 Masela et al. ..... D9/773
3,688,538 A * 9/1972 Hoyne ..... 72/94
3,759,203 A * 9/1973 Frankenberg ..... 72/370.05
4,155,474 A * 5/1979 Bizzarri ..... 215/365
D256,645 S * 9/1980 Keough ..... D7/523
4,372,737 A * 2/1983 Thompson ..... 425/393
D282,442 S 2/1986 Kohnle
5,100,017 A * 3/1992 Ishinabe et al. ..... 220/669
5,261,558 A * 11/1993 Claydon ..... 220/671
5,279,442 A * 1/1994 Jentzsch et al. ..... 220/671
5,346,095 A * 9/1994 Deal ..... 220/669
5,346,098 A * 9/1994 King et al. ..... 222/146.5
D370,850 S 6/1996 Beaver
5,704,244 A * 1/1998 Halasz et al. ..... 72/353.6
D401,508 S 11/1998 Brown, III
5,832,766 A * 11/1998 Hartman et al. ..... 72/62
5,868,272 A * 2/1999 Deal ..... 220/669
5,878,906 A 3/1999 Bolton et al.
5,893,286 A * 4/1999 Johnson et al. ..... 72/17.3
6,029,837 A * 2/2000 Slat et al. ..... 215/384
6,145,681 A 11/2000 Chimetto et al.
6,164,474 A 12/2000 Cheng et al.
6,264,053 B1 * 7/2001 Slat ..... 215/384
D449,000 S 10/2001 Brown, III
D462,012 S 8/2002 Manderfield, Jr.
D468,203 S 1/2003 Gittins et al.

(Continued)

*Primary Examiner*—Sue A Weaver
(74) *Attorney, Agent, or Firm*—Fitch, Even, Tabin & Flannery

(57) ABSTRACT

A grippable container is provided for foodstuffs and other items, in which the container includes a closed bottom, an open top, and a body extending between the bottom and top, wherein the body includes a plurality of gripping indentations which are circumferentially spaced apart at an obtuse angle from each other. The grippable indentations each comprise a recess on the container body that has a relief pattern of substantially parallel projections, such as ribs. The grippable indentations on the container make it possible for a user to easily grasp and pick up a relatively large container from the side with enhanced control.

28 Claims, 6 Drawing Sheets

U.S. PATENT DOCUMENTS

| | | | | |
|---|---|---|---|---|
| D474,377 | S | 5/2003 | Holsinger | |
| D476,898 | S | 7/2003 | Schuller et al. | |
| D480,312 | S | 10/2003 | Mungar et al. | |
| 6,802,196 | B2 * | 10/2004 | Gong et al. | 72/58 |
| 7,080,747 | B2 * | 7/2006 | Lane et al. | 215/381 |
| 2003/0010787 | A1 | 1/2003 | Dalton et al. | |
| 2005/0218108 | A1 * | 10/2005 | Bangi et al. | 215/384 |
| 2006/0027640 | A1 * | 2/2006 | Smith et al. | 229/400 |
| 2006/0243699 | A1 * | 11/2006 | Smith | 215/384 |

* cited by examiner

FIG. 5
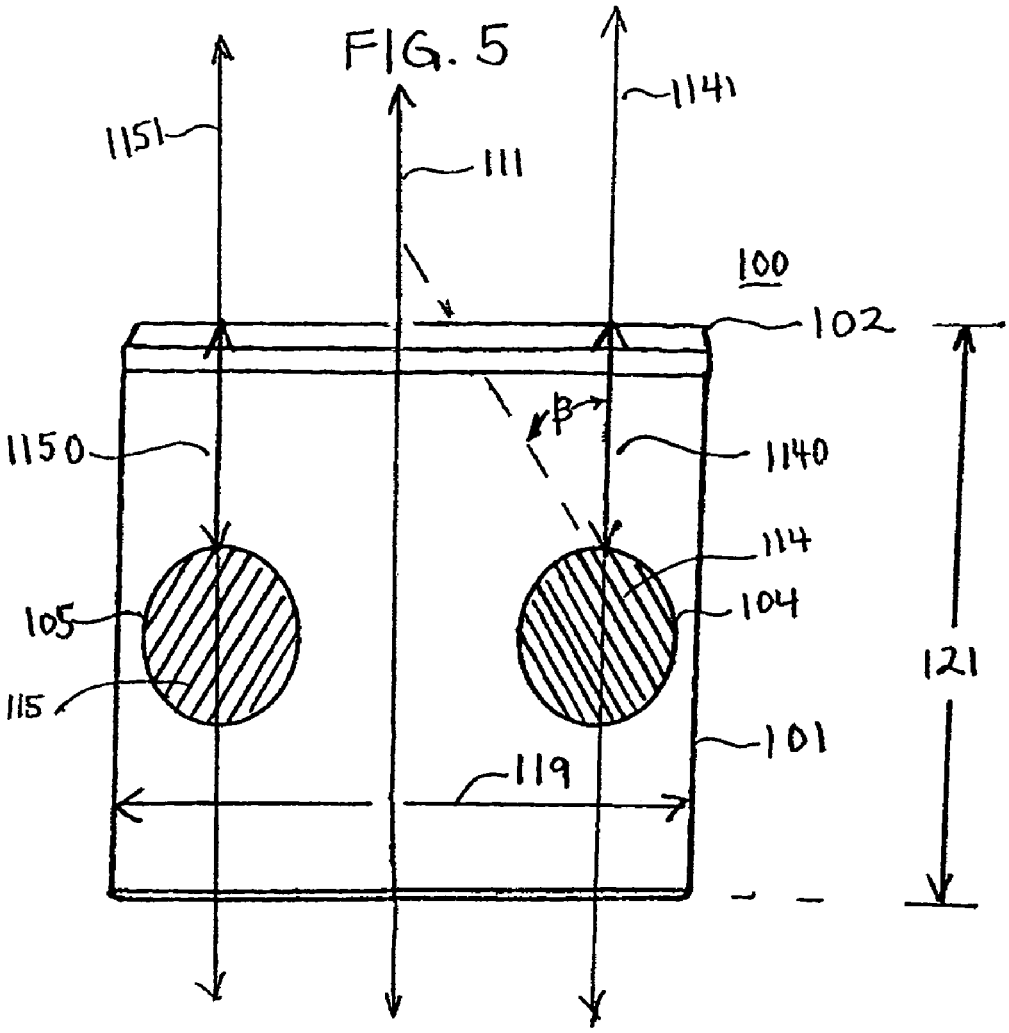
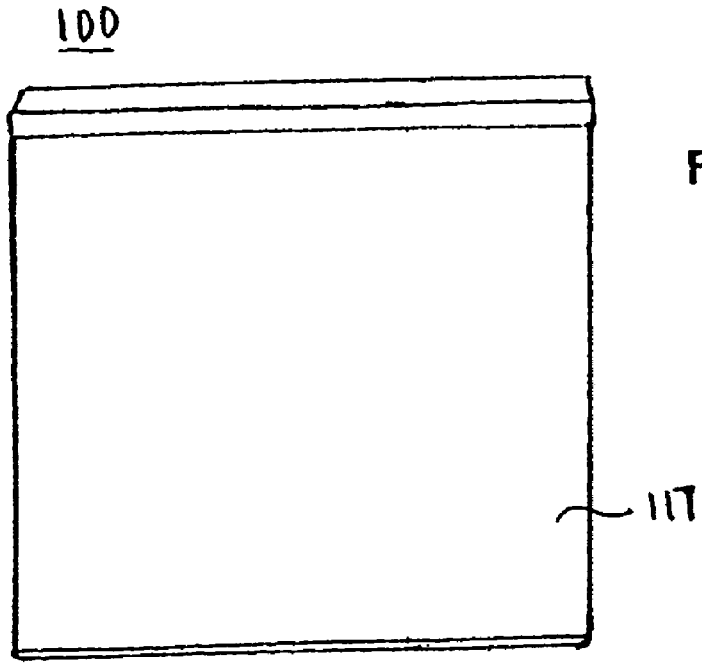
FIG. 6

CONTAINER HAVING GRIPPING RECESSES

FIELD OF THE INVENTION

The present invention relates to containers for packaging and storing food and other items and, more particularly, to containers with grip area arrangements to enhance handling of such containers.

BACKGROUND OF THE INVENTION

Containers for packing and storing foodstuffs and other items can be rounded and relatively rigid and large mouthed, such as those, for example, commonly used to commercially package coffee. Consumers often handle such containers repeatedly before the contents are depleted. If such containers are too large, the user may need to handle them with both hands to have a sure grip. Users having relatively small hands compared to the size of the container or weak hands may find it difficult if not impossible to handle the container properly, and may drop the container or spill or dispense too much of the contents.

A variety of features have been added to containers as attempts to address handling of relatively large containers. Each of these has shortcomings. For example, one attempt employs an external handle or handles projecting from surfaces of containers to aid users in grasping the containers, which generally is undesirable as the protruding handles increase production cost, and complicate packaging and shelving and consume too much space.

Another attempt employs integrated grip portions located on opposite sides of a container, such as a bottle, in which the grip portions comprise a grip panel having multiple inclined ribs, finger slots, and cross-hatch ribs, which generally is not useful on larger diameter containers.

There is a need for more easily-grippable containers for foodstuffs and other items which are non-cumbersome, cost-reasonable arrangements convenient for packaging, storage and handling.

SUMMARY OF THE INVENTION

A container is provided with at least one sidewall, a bottom attached to the at least one sidewall and a body formed by at the at least one sidewall and the bottom. The bodying has at least a hollow interior volume and an open end and defines at least two recesses spaced apart from each other by an obtuse angle. At least one of the recesses has a plurality of gripping projections.

The container further may include a removable closure for covering the open end. The closure may attach to the body by a protuberance at the open end of the body. The obtuse angle may be at least about 110 degrees or may also be in range about 110 degrees to about 130 degrees. The at least two recesses may be located at substantially the same longitudinal distance from the open end of the container.

The body of the container also may define at least three recess spaced apart from one another by first and second obtuse angles. The first and second obtuse angles may be at least about 110 degrees or may be in the range of about 110 degrees to about 130 degrees.

The body also may have a longitudinal direction and the plurality of gripping projections may include elongated ribs extending substantially parallel to each other and oriented at an absolute angle of no more than about 75 degrees relative to the longitudinal direction of the body. The ribs also may be oriented at an absolute angle in the range of about 40 degrees to about 50 degrees. Further, the ribs may be oriented at an absolute angle of about 5 degrees or less relative to the longitudinal direction of the body.

The body may be substantially cylindrical. The body may have a longitudinal direction and a cross-sectional dimension transverse to the longitudinal direction of greater than about 15 centimeters. The cross-sectional dimension also may be in the range of about 15 centimeters to about 25 centimeters. The body may comprise metal.

The interior volume may contain a food substance. The food substance may be a coffee product.

A method for making a container includes the steps of providing a body comprising a debossable material, clamping the body effectively to restrict movement of the body when being debossed, debossing at least two integral gripping areas separated circumferentially by an obtuse angle in the body, in which the gripping areas individually comprise a recess including a ribbed relief pattern therein, and attaching a bottom to the annular body to form a container defining an interior volume before or after debossing the at least two integral gripping areas in the body.

The method may further comprise introducing food substance into the interior volume of the container, optionally flushing the container with inert gas, and covering the open end of the container with a closure. The foodstuff may comprise a particulate product such as a coffee product (e.g., roast and ground coffee).

The method also may include curling a sheet metal blank into a cylindrical shape having two free longitudinal edges, and joining the free longitudinal edges of the cylindrical shape to form a completely enclosed cylindrical preform. The method may also include the debossable material being comprised of sheet metal.

BRIEF DESCRIPTION OF THE DRAWINGS

FIG. 5 is a front elevational view of the container of FIG. 1;

FIG. 6 is a rear elevational view of the container of FIG. 1;

DETAILED DESCRIPTION OF THE PREFERRED EMBODIMENTS

Figure 1:
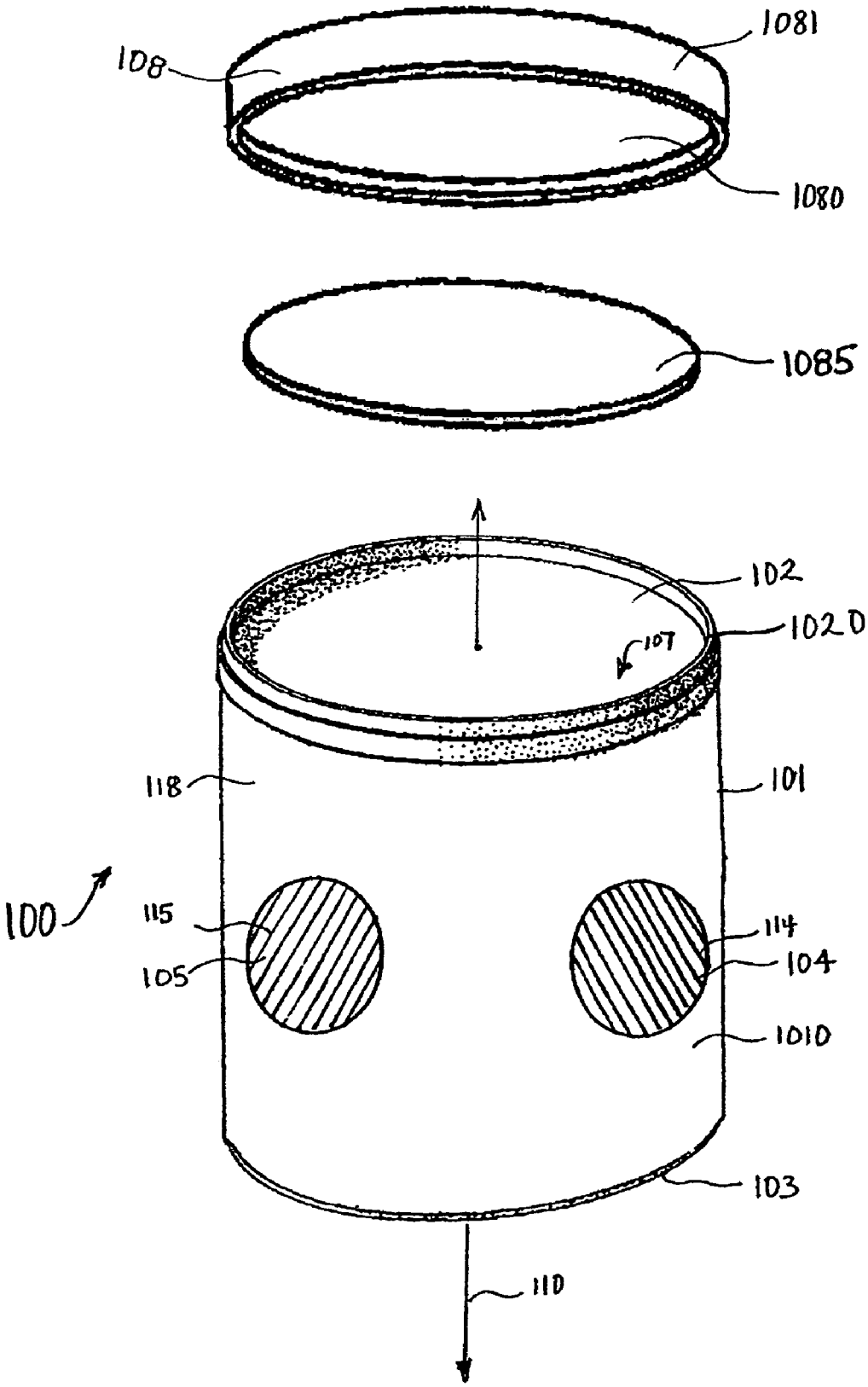
FIG. 1 is an exploded perspective front view of a grippable container embodying features of the present invention.

Referring to FIG. 1, container 100 is illustrated having at least two debossed grippable indentations 104 and 105 to assist users in handling the container. A relief pattern of ribs or ridges 114 and 115, respectively, is included in each of the indented areas 104 and 105 to provide a finger gripping structure which significantly reduces finger slippage, as well as provides an ergonomically improved gripping area suitable for most consumers.

As shown, the container 100 includes a closed bottom 103, an open top 102, and an annular sidewall 101, which includes gripping indentations 104 and 105. The sidewall 101 extends between the bottom 103 and the top 102 to define a container body 101 with an interior volume 107. Preferably, a non-debossed land area 1010 of the container body 101 substantially surrounds indentations 104 and 105. The container is generally cylindrical and has longitudinal axis 110 that coincides with the geometric center of the interior volume 107. A closure lid 108 is removably attachable to a protuberance 1020 at the open top 102 of the container 100. The preferred container is made of metal. The preferred container also has the grippable container 104 and 105 on its front portion of the container 100 so that when the container is stocked on a shelf or in a cabinet, the front side preferably is faced outward so that the grippable areas can be used to handle the container.

Figure 2:
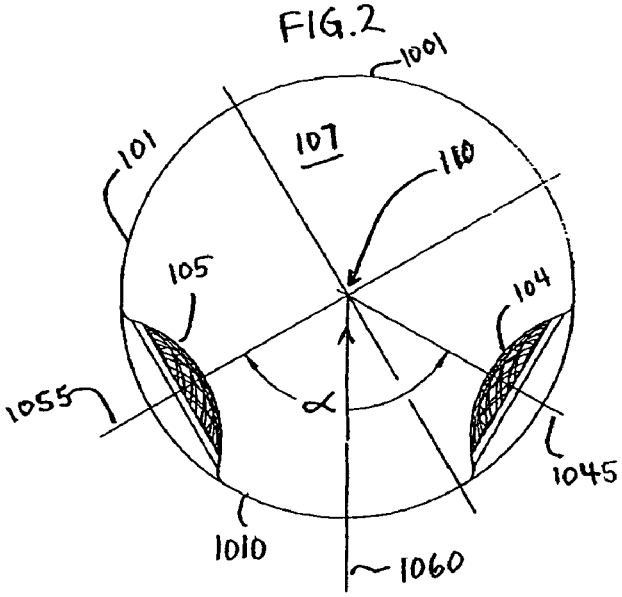
FIG. 2 is a plan view of the container of FIG. 1.

Referring to FIG. 2, the debossed gripping indentations 104 and 105 each are integrally formed from the side wall 101. The container body 101 has a circumference 1001 that traces its cross-sectional perimeter. The indentations 104 and 105 preferably have a partially spherical profile that extends inward into the interior volume 107 of the annular body 101.

The grippable indentations 104 and 105 are circumferentially spaced apart from one another by a predetermined angular distance. For example, the grippable indentations are spaced apart by an obtuse angle $\alpha$, which is measured around the container's circumference 1001 between the geometric centers 1045 and 1055, respectively, of the grippable indentations 104 and 105. "Obtuse" means more than 90 degrees and less than 180 degrees. In one configuration of the grippable areas, at least two separate grip indentations are spaced apart in an angular range of about 110 to about 130 degrees. This angular range enhances a user's ability to grip the two gripping indentations simultaneously from the front portion with different fingers on the same hand (e.g., thumb and forefinger), or using fingers or palms of both hands. If the grippable indentations are too close together, it becomes difficult to exert a compressive grip about the container and its longitudinal axis so as to be able to effectively handle the container. If the grippable indentations are spaced too far apart around the container, it becomes difficult to see one or the other grippable indentations from the front perspective or to grasp the container with one hand.

Figure 3:
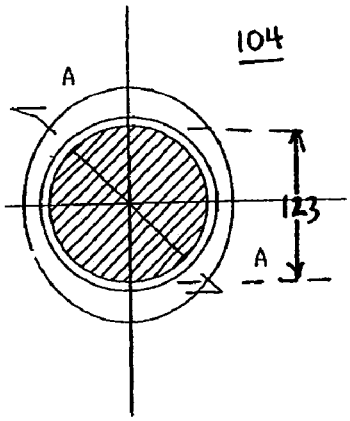
FIG. 3 is an enlarged partial side view of the container of FIG. 1 showing one of the grippable areas.

Referring to FIG. 3, grippable indentation 104 is illustrated, which is also illustrative of grippable indentation 105. The preferred grippable indentation 104 has a substantially circular perimeter. Although the substantially circular perimeter is preferred it can be of other shapes, e.g., oval, spherical, squares, rectangular, triangular, etc. Also, the circular grippable indentation 104 has a diameter 123 which provides an effective balance between sufficient user access and gripping enhancement for the user.

Figure 4:
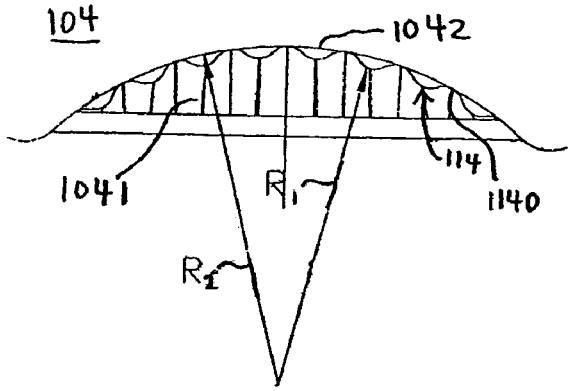
FIG. 4 is an enlarged cross-sectional view of a grippable area of the container of FIG. 1 taken along line A-A shown in FIG. 3.

Referring to FIG. 4, grippable indentation 104 is illustrated and is also illustrative of grippable indentation 105 for purposes of this discussion. The grippable indentation 104 comprises an upraised relief pattern comprised of a series of substantially parallel ribs 114 and intervening grooves 1140 in a regular alternating pattern. The preferred ribs and intervening grooves have substantially similar width and height dimensions, albeit opposite to one another. In a preferred embodiment, the rib pattern is provided across substantially all the surface area of the indentation 104. For example, the heights of each rib can be correlated to the indentation wherein a radius of curvature $R_1$, which is tangential with the peaks of the rib, is about 90% to about 97% of the radius of curvature $R_2$ applicable to the valley between each rib, also referred to as the base line 1042 of the indentation. This rib height provides an ample contour and adequate well 1041 within indentation 104 for one to insert and seat fingers deeply enough within the recess to aid in firmly gripping of the container.

Referring to FIG. 5, the container body 101 is cylindrical and illustrated in upright, generally vertical direction 111. The two grippable indentations 104 and 105 are each spaced from the top 102 of the container 100 a predetermined longitudinal distance 1140 and 1150. Preferably, the longitudinal distances 1140 and 1150 are substantially the same distance from the top 102 of the container 100 fore ach to aid a user in properly aligning his or her fingers or hands on the grippable indentations 104 and 105 at the same time. The longitudinal distances 1140 and 1150 may be any value less than the vertical height 121 of the container 100 which enables the desired size of the grippable indentation to fit entirely onto the body 101. It is preferred that the grippable indentations are located within the middle third of the vertical height dimension of the container to enhance controlling and handling of the container.

Referring still to FIG. 5, the grippable indentations 104 and 105 each include a series of substantially parallel ribs at the surface of the indentation. The ribs are oriented at a predetermined angle relative to an axis 1141 and 1151 through the respective indentations 104 and 105. Each axis 1141 and 1151 is generally parallel to the longitudinal axis 111 of the container 110. The preferred angle $\beta$ is the range of about 75 degrees (absolute) or less, and preferably about 40 to about 50 degrees (absolute), relative to the respective axis 1141 and 1151. This recommended range, however, is not to suggest that orientations outside the range cannot be employed. It should be understood that orientations outside this range may lessen the ability of a user to obtain a heightened grip from the relief pattern.

Further, the orientation angle of a particular relief pattern of ribs may be independently selected amongst different indentations as well as other grippable features provided on the same container body. For example, the angle of inclination of the series of ribs of one grippable indentation may be the same or different from that of a different grippable indentation on the same container. Moreover, the ribs of different orientations can be slanted toward one another. The selection of similar, differing, or symmetrical rib angle orientations, as between different grippable indentations on the same container, may be practiced, if desired, to enhance the performance and/or visual impact of the container.

Referring to FIG. 6, the rear side 117 of the container 100 does not include a grippable indentation.

As shown in FIG. 1 the container body 101 includes a protuberance 1020 continuously disposed around the perimeter of the container body 101 at the open top 102. A closure lid 108 may be provided that is removably attached to the body 101 by the protuberance 1020 so that the closure forms a seal with the body 101 to close off the interior volume 107. The closure is preferably flexible and may be made of a plastic or metal. The preferred closure 108 comprises a circular disc 1080 and an annular skirt portion 1081 integral at the perimeter of the disc 1080 for a snug but slidable fitting over the perimeter of the protuberance 1020 at the open container top 102. Generally, the skirt portion 1081 has a hook shape for lockingly engaging protuberance 1020 of container 100. Preferably, closure 108 is re-usable to reclose the container after it is opened numerous times to dispense contents therefrom.

In some instances, a seal between the closure and the open top should provide a seal sufficient to maintain freshness of the food product, such as roasted ground coffee contained within the interior volume 107 of the container 100. Other materials also may be stored within container 100 that require a substantial seal between the cover and the container.

In some instances, a food product is packaged under pressurized conditions, such as roasted ground coffee, in which it may be desirable to close and seal the container, at least initially, in an even more air-tight manner. For instance, a substantially flat circular sealing lid 1085 may be sealingly attached directly along the protuberance 1020 in a substantially air-tight manner, such as via heat sealing, welding, or mechanical attachment. Then, the closure 108 may be placed on the top of the resulting sealed container. The sealing lid 1085 may be punctured or detached completely to permit dispensing of the contents of the container 100. For example, commonly assigned U.S. Pat. No. 5,878,906 describes a container closure system embodying a sealing lid which mates to a container body via a sidewall hook, which descriptions are incorporated herein by reference. The closure 108 may be used as an overcap which can be used to repeatedly close the container 100 between dispensing times, such as after puncturing or removal of the sealing lid 1085. It will be appreciated that the closure 108 and or sealing lid 1085 may be used on a particular container.

Figure 7:
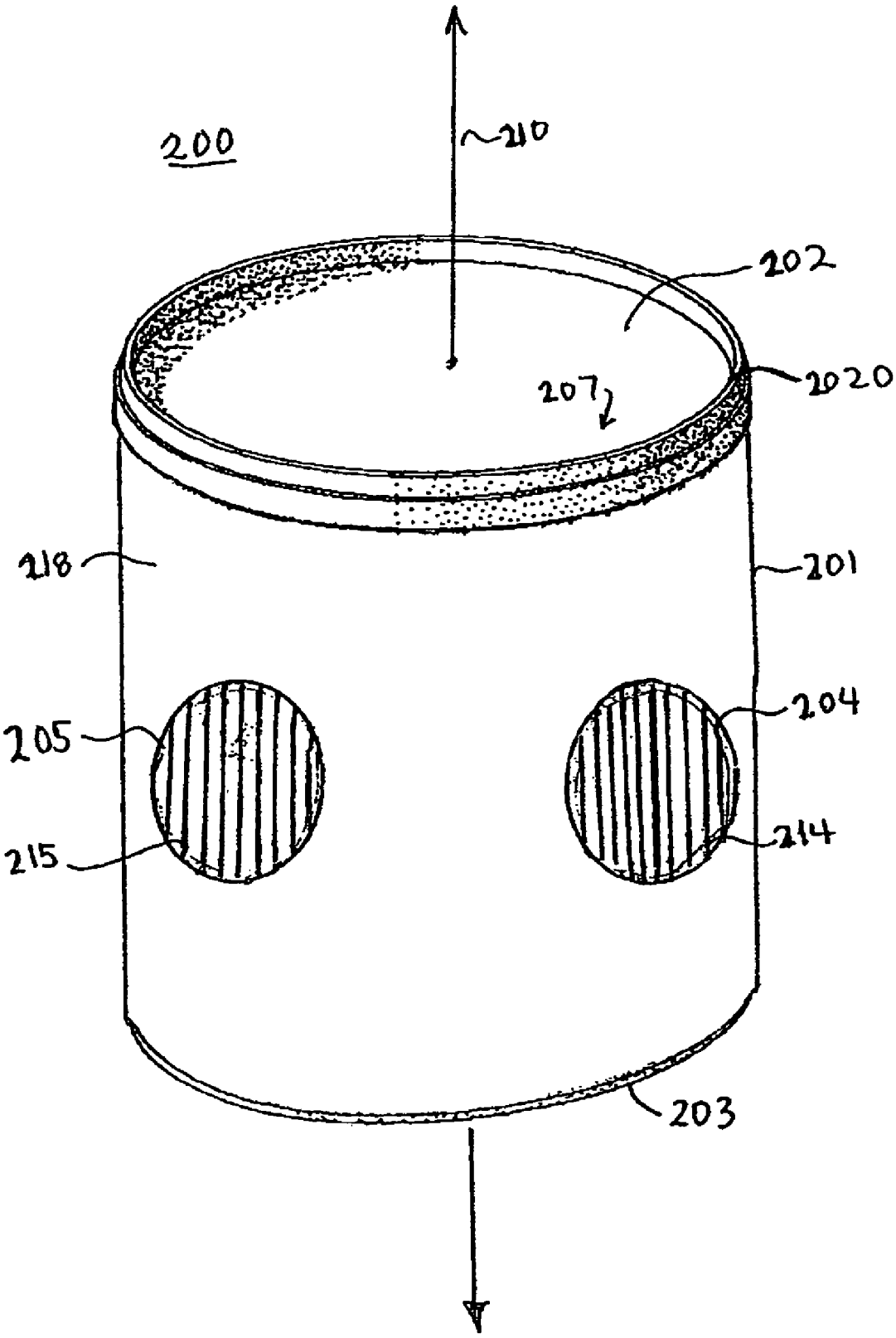
FIG. 7 is a perspective front view of another grippable container embodying features of the present invention.
Figure 8:
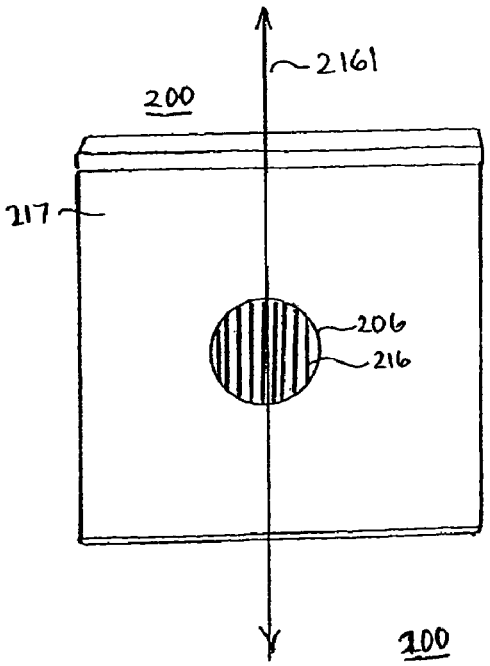
FIG. 8 is a rear elevational view of the container of FIG. 7.

Referring to FIGS. 7 and 8, a grippable container 200 is illustrated having a front side 218 and a rear side 217, and three grippable indentations. A sidewall 201 extends between a bottom 203 and an open top 202 to define a container body 201 with an interior volume 207. The container 200 is generally cylindrical and has longitudinal axis 210 that coincides with the geometric center of the interior volume 207. A protuberance 2020 is provided on the container body 201 at the open top 202 for attachment of a closure (not shown). A lid closure similar to lid 108 and or sealing lid closure similar to sealing lid 1085 shown in FIG. 1 and described above also may be used in combination with container 200.

Two grippable indentations 204 and 205 are at front side 218 of the container 200, and a third grippable indentation 206 is at the rear side 217 in FIG. 8. The three grippable indentations 204, 205, and 206 are substantially equidistantly spaced around the circumference of the container body 201. An advantage of this arrangement is that the container can be easily and conveniently grasped by a user approaching the container from any general direction.

Each grippable indentation 204, 205, and 206, also has an upraised relief pattern formed from the container body. Each relief pattern includes a plurality of substantially parallel ribs 214, 215, and 216, respectively. The ribs 214, 215, and 216 are arranged as a series of alternating ribs and grooves, similar to that of container 100 described with reference to FIG. 3. The ribs 214, 215, and 216 also generally have dimensions and patterns preferably similar to those of the ribs 114 of the container 100 described in connection with FIG. 3.

Figure 9:
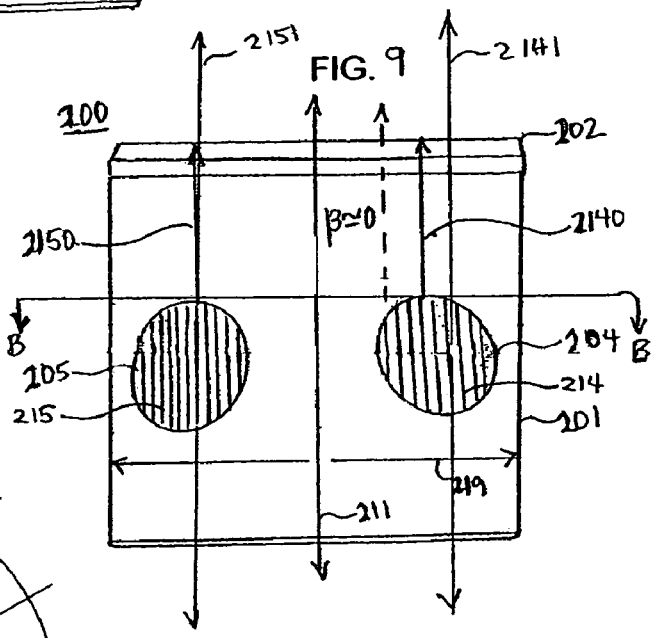
FIG. 9 is a front elevational view of the container of FIG. 7.

Referring to FIG. 9, the container body 201 is cylindrical and illustrated in upright, generally vertical direction 211. As with container 100, it is preferred that the ribs of a particular relief pattern be oriented at an angle in the range of about 75 degrees (absolute) or less relative to a longitudinal axis through the respective indentation and which is parallel to the vertical direction 211 of the container 200. For example, the ribs 214 make an angle β of approximately zero degrees with respect to the indentation's central vertical axis 2141, the ribs 215 make an angle β of approximately zero degrees with respect to the indentation's central vertical axis 2151. The ribs 216 in the third grippable indentation 206 also have a similar approximately zero degree angular orientation relative to the indentation's central vertical axis 2161 (see FIG. 8). Moreover, the particular angle β provided for each of the set of ribs 214, 215, and 216 can vary independently from one another. Although the orientation is not limited here, experience reveals the orientation of ribs horizontally, that is substantially parallel to direction 219, is the least desirable due to the loss of gripping ability. As also shown in FIG. 9, it is preferred to locate the gripping indentations 204, 205, and 206 (not shown in this view), all at substantially the same longitudinal distances 2140 and 2150, and so forth, from the top 202 of the container body 201.

Figure 10:
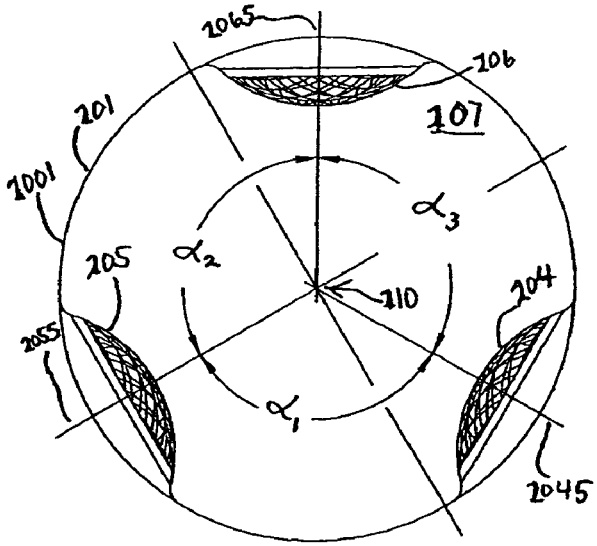
FIG. 10 is a cross-sectional view of the container of FIG. 7 taken along line B-B of FIG. 9.

Referring to FIG. 10, the three grippable indentations 204, 205, and 206 are integrally formed the sidewall of the container body 201. The indentations 204, 205, and 206 also are preferably spaced apart at obtuse angles $\alpha_1$, $\alpha_2$, $\alpha_3$, respectively, which are measured around the container's circumference 2001 between the geometric centers 2045, 2055, and 2065, respectively, of the grippable indentations 204, 205, and 206. Each angle $\alpha_1$, $\alpha_2$, and $\alpha_3$ independently is in the angle of about 10 to about 130 degrees as measured around the circumference 2001 of the container body 201. As noted, this three-way gripping configuration permits a container to be easily approached from any side direction.

Grippable indentations, such as those described above, employing features of the present invention are particularly useful on relatively large round metal containers, such as those having a diameter of greater than about 6 inches (15 cm) and more particularly in the range of about 6 to about 10 inches (about 15 to about 25 cm). They also may be used on round containers having other diameters.

Figure 11:
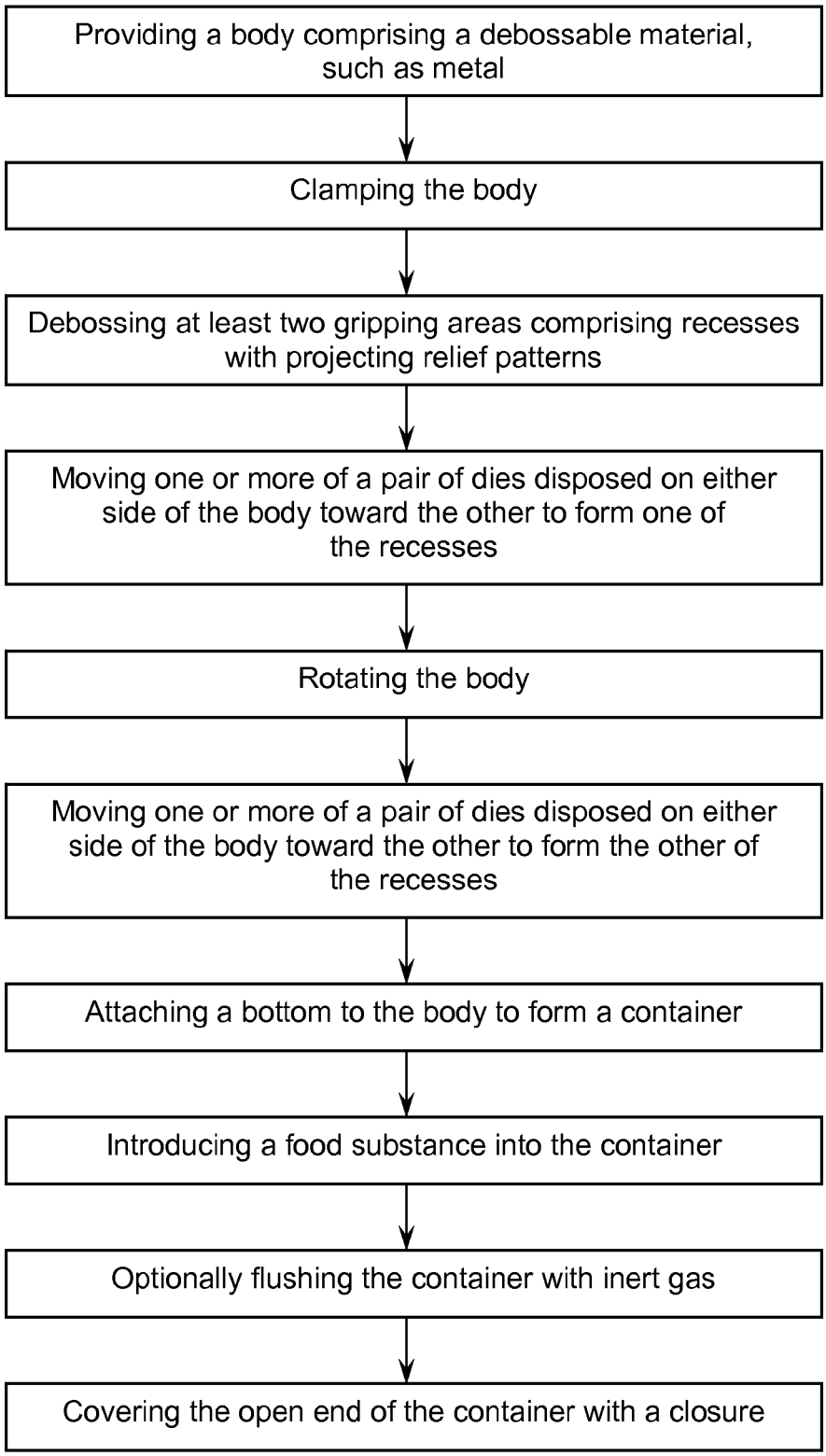
FIG. 11 is a depiction of steps, including optional steps, for forming the containers disclosed herein.

The integral grippable indentations may be formed by a debossing process, such as depicted in FIG. 11, in which an indentation is formed so as to extend radially inward into the interior volume defined by the container body. The indentation may be partially spherical-shaped and includes a grip-enhancing pattern superimposed upon it at least at its base. As explained above, the relief pattern may have a contour comprising an upraised pattern of ribbing or ridges therein. In addition, a land area (non-debossed region of the container body) that completely surrounds each indentation having the rib-contoured base may be provided.

The body of the container may be formed of any material that may be formed into a self-supporting annular shape sheet that can incorporate the integral grippable indentations described herein. Thin sheet metal may be used as the substrate, such as aluminum alloy or tin sheeting, including types commonly used for general metal can construction. For example, the basic shape of the container body may be formed by curling a thin sheet metal blank into a round annular shape and joining the edges to form a seamed rounded body (i.e., a cylinder with two open ends). The metal sheet may be joined at its confronting lengthwise edges upon being curled, such as by conventional welding used for that purpose. Before filling the container, a bottom piece is sealingly attached at one end of cylindrical body, such as in a conventional manner, to provide an open-mouthed container having a cylindrical body with a closed bottom and an open top. The container bottom may be attached before or after formation of the grippable indentations in the container body. To form the gripping indentations, at least one end of the container needs to be left open to permit convenient movement of preform gripping (holding) and debossing equipment relative to the container preform body.

For instance, the grippable indentations described herein preferably are fabricated into the sheet metal after a sheet metal blank has been shaped into an annular-shaped or cylindrical body. In one aspect, the grippable indentations may be physically formed in the preformed sheet metal cylinder by any suitable shaping technique useful for forming inset relief patterns at discrete locations in curvilinear-shaped sheet metal. Debossing techniques may be used in which a preformed cylinder comprised of sheet metal is first immobilized by temporary yet secure holding means. For example, clamping arrangements may be used that can rigidly hold a cylinder in a controllable and releasable manner, yet which leave ample space available within the container interior for movement of a die in and out.

Then, a pair of debossing dies are used to form the grippable indentations, such as described herein, at multiple predetermined locations around the securely-held, preformed container body. A pair of complementary debossing dies may be provided that are operably controlled for reciprocal movement across the sidewall of the intervening cylinder while it is securely held in position. The mating dies are moved to a common location on opposite respective sides of the cylinder wall where a debossed grippable indentation is to be formed. The debossing dies are directionally controllable and equipped to receive compressive pressure at directions substantially normal to the longitudinal direction of the preformed container body to effectively squeeze the intervening area of the cylinder wall from opposite sides thereof and form therein an indentation incorporating an integral relief pattern that facilitates hand gripping as imparted by the complementary shaped dies. Therefore, a pair of dies are positioned over a desired location of a grippable indentation on the container body, and then, sufficient die pressure is exerted to form a desired relief pattern in the cylinder wall embodying a ribbed pattern described herein. During debossing, the cylinder is rigidly held so that the overall shape and dimensions of the cylinder are not distorted except at the debossed area.

After forming a grippable indentation, the pair of dies, or alternatively, the cylinder, is then rotated through an obtuse angle, and a second gripping indentation is similarly formed in the sidewall of the cylinder at a second location. For containers having three gripping indentations, the procedure is repeated one more time. As noted, it is desirable to provide two or three of the gripping indentations with the container body at locations having approximately 110-130 degrees spacing from one another around the circumference of the container body.

The plurality of grippable indentations may be formed sequentially in a container body. It also may be possible to simultaneously form more than one grippable indentation in a common preformed container body if the interior space available in the securely held container is sufficiently large to permit multiple debossing dies for different sets of debossing dies to fit within the interior body space at the same time.

Additionally, a bottomless preformed cylinder container may be held in an upright position beneath a set of reciprocal debossing dies that can be moved vertically up and down the immobilized sidewall of the container. After being debossed to provide a plurality of separate gripping indentations, construction of the container continues to the extent needed, such as to add a bottom if not already present. Although formation of the debossed relief patterns in a metal sheet blank is less desired due to higher risk of the metal blank moving during debossing, which can distort the dimensions of the finished blank, it remains contemplated within the subject matter here.

The round container with integral grippable indentations also may be produced in a single operation by blow molding thermoplastic material. The thermoplastic material must have sufficient structural rigidity such that grippable indentations formed therein can be grabbed by users without the container body collapsing inward such that fingers slip off the relief pattern and sure grip is lost from the grippable indentations.

If extrusion blow molding is used, an extruder is fitted with a die head which produces the preform by downward extrusion of a tube of thermoplastic, and while the preform is still soft, it is pinched between two halves of a mold and a blow pin protrudes from the die core, such as in a conventional manner. The soft preform is blown against the cooled mold surfaces by air injected through the blow pin. The die includes contoured areas for forming reliefs corresponding to gripping indentations in the soft preform. After the thermoplastic material solidifies in contact with the cooled molding surfaces, the mold is opened and the container product having gripping indentations integrally formed therein is ejected.

The thermoplastic material used in making containers preferably is polyolefinic. More preferably, when oxygen-sensitive foodstuffs will be packed in the container, the thermoplastic material includes a low-oxygen permeability layer. As a non-limiting example, the thermoplastic material may be a multilayered structure, such as including outer layers of high density polyethylene (HDPE), polypropylene, or polyethylene terephthalate useful as moisture barriers, which sandwich an intervening ethylene vinyl alcohol layer or the like useful as an oxygen barrier. The blow molding processes can be used with multi-layered plastic structures by incorporating additional extruders for each resin used. Alternatively, injection molding and stretch blow molding may be used to form the containers with integral gripping indentations as described.

While the invention has been particularly described with specific reference to particular processes and embodiments, it will be appreciated that various alterations, modifications and adaptations may be based on the present disclosure, and are intended to be within the spirit and scope of the present invention as defined by the following claims.

What is claimed is:

1. A container comprising:

at least one sidewall;

a bottom attached to the at least one sidewall;

a body formed by at the at least one sidewall and the bottom, the body having at least a hollow interior volume and an open end;

the body defining at least two recesses spaced apart from each other by an obtuse angle; and at least one of the recesses having a plurality of gripping projections including elongated ribs extending substantially parallel to each other and oriented at an absolute angle of no more than about 75 degrees relative to a longitudinal direction of the body, and wherein a radius of curvature of heights of each rib are between about 90% and about 97% of a radius of curvature of a base line of a recess between each rib.

2. The container of claim 1 further comprising a removable closure for covering the open end and wherein the closure attaches to the body by a protuberance at the open end of the body.

3. The container of claim 1 wherein the obtuse angle is at least about 110 degrees.

4. The container of claim 3 wherein the obtuse angle is in the range of about 110 degrees to about 130 degrees.

5. The container of claim 3 wherein the at least two recesses are located at substantially the same longitudinal distance from the open end of the container.

6. The container of claim 1 wherein the body defines at least three recesses spaced apart from one another by first and second obtuse angles.

7. The container of claim 6 wherein the first and second obtuse angles are at least about 110 degrees.

8. The container of claim 7 wherein the first and second obtuse angles are in the range of about 110 degrees to about 130 degrees.

9. The container of claim 1 wherein the ribs are oriented at an absolute angle in the range of about 40 degrees to about 50 degrees.

10. The container of claim 1 wherein the ribs are oriented at an absolute angle of about 5 degrees or less relative to the longitudinal direction of the body.

11. The container of claim 1 wherein the body is substantially cylindrical.

12. The container of claim 1 wherein the body has a longitudinal direction and a cross-sectional dimension transverse to the longitudinal direction of greater than about 15 centimeters.

13. The container of claim 12 wherein the cross-sectional dimension is in the range of about 15 centimeters to about 25 centimeters.

14. The container of claim 1 wherein the body comprises metal.

15. The container of claim 1 wherein the interior volume contains a food substance.

16. The container of claim 15 wherein the food substance is a coffee product.

17. The container of claim 1, wherein the elongated ribs extend from one side of the recess to an opposite side of the recess.

18. The container of claim 1, wherein the elongated ribs are provided across substantially all of a surface area of the recess.

19. A method for making a container, comprising:

providing a body comprising a sidewall of a debossable material;

clamping the body effective to restrict movement of the body when debossed;

positioning a pair of complementary dies on opposite respective sides of the sidewall;

debossing at least two integral gripping areas by moving one or more of the dies toward the other die, the gripping areas separated circumferentially by an obtuse angle in the body, in which the gripping areas individually comprise a recess including a projecting relief pattern therein, wherein the relief pattern comprises elongated ribs extending substantially parallel to each other, and wherein a radius of curvature of heights of each rib are between about 90% and about 97% of a radius of curvature of a base line of a recess between each rib; and attaching a bottom to the body to form a container defining an interior volume before or after debossing the at least two integral gripping areas in the body and having an open end.

20. The method of claim 19, further comprising:

introducing a food substance into the interior volume of the container;

optionally flushing the container with inert gas; and covering the open end of the container with a closure.

21. The method of claim 20, wherein the food substance comprises a coffee product.

22. The method of claim 21, wherein providing the body comprises:

curling a sheet metal blank into a cylindrical shape having two free longitudinal edges; and joining the free longitudinal edges of the cylindrical shape to form a completely enclosed cylindrical preform.

23. The method of claim 19, wherein the debossable material comprises sheet metal.

24. The method of claim 19, wherein the step of debossing further includes debossing one of the recesses by moving one or more of the dies toward the other die, followed by rotating the body through an obtuse angle and then debossing another of the recesses by moving one or more of the dies toward the other die.

25. The method of claim 24, wherein the step of debossing further includes rotating the body through a second obtuse angle and then deposing a further recess by moving one or more of the dies toward the other die.

26. The method of claim 19, wherein the step of debossing includes:

positioning a plurality of pairs of complimentary dies on opposite respective sides of the sidewall; and simultaneously debossing a plurality of recesses in the body by moving one or more of the dies of each pair toward its complementary die to form each recess.

27. The method of claim 19, wherein the step of debossing further includes debossing one of the recesses by moving one or more of the dies toward the other die, followed by rotating the pair of dies through an obtuse angle and then debossing another of the recesses by moving one or more of the dies toward the other die.

28. The method of claim 27, wherein the step of debossing further includes rotating the pair of dies through a second obtuse angle and then deposing a further recess by moving one or more of the dies toward the other die.

* * * * *

UNITED STATES PATENT AND TRADEMARK OFFICE

CERTIFICATE OF CORRECTION

PATENT NO. : 7,578,412 B2
APPLICATION NO. : 10/897401
DATED : August 25, 2009
INVENTOR(S) : Eric D. Clamage It is certified that error appears in the above-identified patent and that said Letters Patent is hereby corrected as shown below:

Column 10, line 28, in claim 25, delete "deposing" and insert -- debossing --.

Column 10, line 45, in claim 28, delete "deposing" and insert -- debossing --.

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,578,412 B2
APPLICATION NO. : 10/897401
DATED : August 25, 2009
INVENTOR(S) : Eric D. Clamage It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1432 days.

Signed and Sealed this

Seventh Day of September, 2010

David J. Kappos

David J. Kappos
*Director of the United States Patent and Trademark Office*